United States Patent [19]

Howells

[11] 4,161,252

[45] Jul. 17, 1979

[54] SET OF SORTING-STACKING BINS

[75] Inventor: John N. M. Howells, Kittery, Me.

[73] Assignee: Recycling & Conservation, Inc., Kittery, Me.

[21] Appl. No.: 852,073

[22] Filed: Nov. 16, 1977

[51] Int. Cl.[2] ..... A47F 3/14

[52] U.S. Cl. ..... 211/126; 206/508

[58] Field of Search ..... 211/126, 128, 194; 248/146; 206/821, 505, 508, 511

[56] References Cited

U.S. PATENT DOCUMENTS

| | | | |
|---|---|---|---|
| 1,331,862 | 2/1920 | Claus | 206/511 |
| 1,862,609 | 6/1932 | Shaw | 206/821 X |
| 2,298,814 | 10/1942 | Weis | 206/508 X |
| 2,429,958 | 10/1947 | Liebmann | 206/508 X |
| 3,895,743 | 7/1975 | Christian | 206/508 X |
| 3,954,178 | 5/1976 | Mason | 206/821 X |
| 4,015,714 | 4/1977 | Silver et al. | 206/511 |

FOREIGN PATENT DOCUMENTS

| | | | |
|---|---|---|---|
| 1581001 | 9/1969 | France | 211/128 |
| 297755 | 11/1965 | Netherlands | 206/508 |

*Primary Examiner*—Roy D. Frazier
*Assistant Examiner*—Robert W. Gibson, Jr.
*Attorney, Agent, or Firm*—Pearson & Pearson

[57] ABSTRACT

A set of sorting-stacking bins includes a plurality of tapered containers, each having upstanding, inclined walls and an integral horizontal bottom and shippable in nested condition to reduce cost. Each container has a horizontally enlarged base with depending peripheral flanges which fit over the rim of the next lower container. The bases are shipped separately flatwise against each other to reduce cost. Upon delivery, each container is snap-fitted on an enlarged base to form an integral, permanent unit, the units being vertically stackable, one on the other, with each having a large top opening for receiving a particular type waste.

15 Claims, 9 Drawing Figures

73
56
48
58
67
49
62
51
64
65
71
54
68
74
72
52
57
55

79
32
26
48
67
71
76
77
78

61
51
71
32
49
59
31
27
66
36
37
64
48
57
72
65
74
53
46
44
47
68
67
69
55
45
47
46
63
62
54

41
26
26
26
42
43
31
31
31
27
27
27
29
29
29
32
32
32
44
53
45

41
29
29
26
26
26
27
27
27
29
31
31
31
32
32
32
44
53
45

SET OF SORTING-STACKING BINS

BACKGROUND OF THE INVENTION

It has heretofore been proposed to provide a vertical stack of identical bins, each with means interengaging the next higher, or lower, bin and each having an upper front opening in the front wall thereof. Such bins have been made, used and sold for many years for use as vegetable bins in a kitchen or for the storage of small parts in a plumbing shop or the like. However, they have the disadvantage that they do not nest, collapse or fold so that the manufacturer is shipping air when they are in transit, and the cost is therefore unduly high. Such units are usually shallow and since the opening is in the front, the objects stored in each bin may fall out of the front opening as the bin becomes full.

A set of bins designed by me for the purpose of sorting and stacking different waste products, such as metal cans; glass bottles, waste paper and garbage went into usage in the town of Nottingham, New Hampshire in 1974 with considerable success. The bins were made of plywood and comprised containers with vertical upstanding side and rear walls, an inwardly inclined front wall and an integral bottom wall. This construction was found too costly for general acceptance by the public since the containers could not be collapsed, folded or nested so that the object of universal adoption to promote conservation of raw material was not attained.

SUMMARY OF THE INVENTION

In this invention the object is to provide a waste or trash bin or receptacle which can be produced and shipped at a cost which will induce householders to purchase a set of the receptacles and use them. It is a further object to provide such a set of bins which can be arranged in a vertical stack, one on the other and which will be of attractive design so that a householder will not refuse to have it in her kitchen.

While one would think that waste or trash could be segregated in the kitchen by using a set of paper shopping bags, each for a different type article, most such waste is wet, for example beer cans, bottles and garbage so that the sides and bottoms of such bags would quickly disintegrate. One such experience of a fractured bag of wet waste would quickly disillusion a housewife and stop conservation cooperation for a lifetime.

Therefore in this invention the bins, or receptacles, comprise tapered containers, blow molded from polyethylene, to provide water resistant, self supporting walls and integral bottom which will not fracture when wet or break when loaded. Separate enlarged bases are formed of polystyrene and each is removably affixed to underlie the integral bottom of a container to reinforce the same while resting as a cover on the large upper opening of the next lower, tapered receptacle.

Thus the receptacles, as disclosed herein, can be shipped with the tapered containers nested one within the other and the enlarged bases shipped separately. Assembly of each container and its combined enlarged base and cover is a "do-it-yourself" "snap-fit" operation. Once assembled the bins are stackable vertically in a pleasing array. The openings are in the plane of the upper rim of each bin and of sufficient size to pass a #10 can. Each bin, (tapered container and attached enlarged base) may be lifted from the stack when full and emptied into an appropriate barrel thereby making segregation at a recycling centre easy.

The set of vertically stackable low cost, separable bins of the invention do not require an expensive rack for support and control while each presents an opening into the next lower bin in the plane of the top of the container permitting 100% filling thereof without spillage. The bins have similar horizontal dimensions for stacking but may have different vertical dimensions for accommodating bulky waste or less bulky waste material.

They may be removed for emptying and replaced in any order, because each base has intermediate, down projecting legs capable of preventing sag due to the weight above, if the lowermost bin is resting on the floor. Horizontal sliding of one bin on the other is prevented by the interengagement of the peripheral flanges on the sides and rear of the next lowermost container and the provision of a tapered boss on the underface of each base which receives the rear upper edge of the next lower container in cooperation with the rear flange of the base.

Figure 6A:
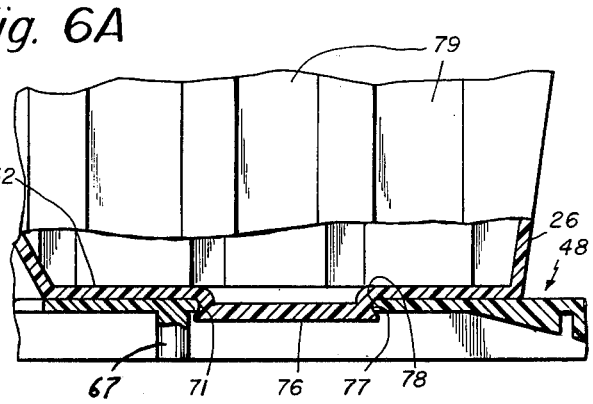
FIG. 6 is an enlarged side elevation in half section of one of the bases of the invention.
Figure 6:
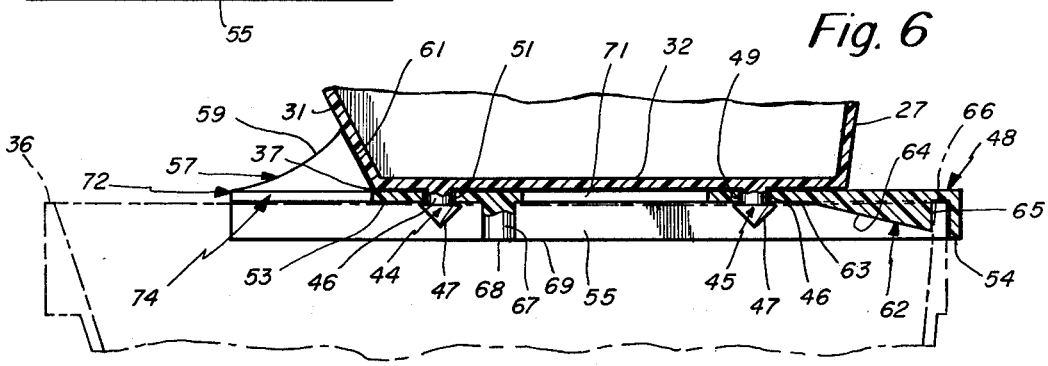
Figure 7:
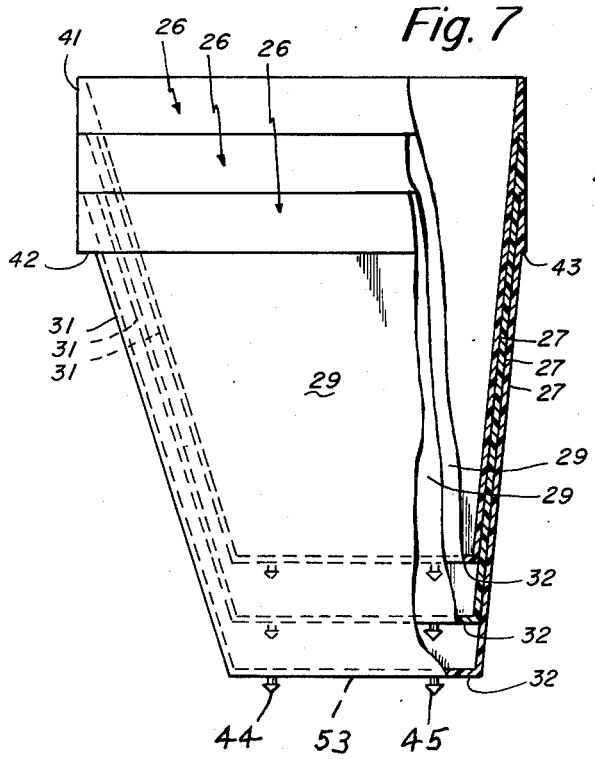
Figure 8:
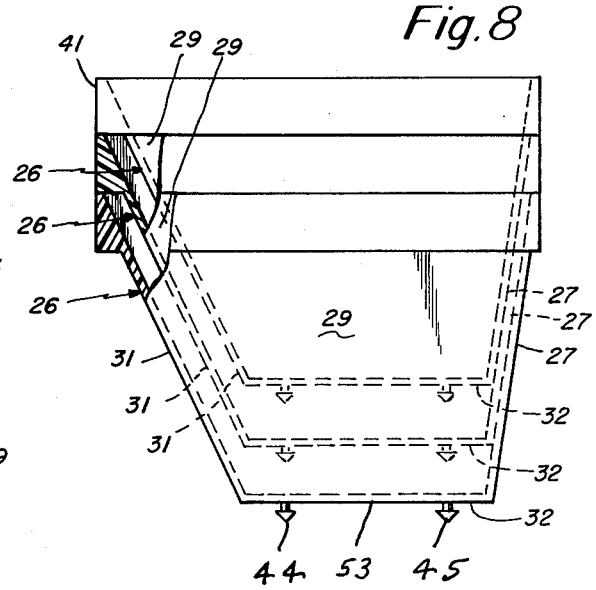

FIG. **6*a* is a view similar to FIG. 6** showing the dropped section snap fitted in the base;

FIG. 7 is a side elevation showing a plurality of the high containers of the invention nested one within the other for storage or shipment; and FIG. 8 is a view similar to FIG. 7 showing a plurality of low containers nested for storage or shipment.

DESCRIPTION OF A PREFERRED EMBODIMENT

In the drawing a vertical stack 20 of bins 21, 22, 23 and 24 of the invention is shown resting on the floor 25 of the kitchen of a typical American home. As stated in my monograph published in February 1974, #IRCZ4 entitled "Nottingham, New Hampshire Recycling System For Solid Waste Management," 1974, the sorting of trash must be accomplished by those who are generating it, namely individual householders. Each householder is supplied with a set of four separable, stackable bins, for example: bin 24 is for glass bottles, bin 23 for metal cans, bin 22 is for clean, flat paper and bin 21 is for soiled, crumpled paper and plastic. The bins disclosed in my said monograph were made of plywood and each bin comprised a container having vertical side walls and rear wall, a front wall inclining from the top inwardly and downwardly to a horizontal bottom, and the bottom having side and rear flanges fitting over the upper edges of the rear and side walls of the next lower container. The bins were bulky and costly to make ship and store, they did not nest, fold or collapse and did not stand up in the sorting and segregating processes or recycling.

In this invention, therefore, the sorting-stacking bins, such as 21, 22, 23 or 24, each comprise a five walled container 26 including a rear wall 27, a pair of side walls 28 and 29, a front wall 31 and an integral bottom wall 32 all of which may be flat and planar or the upright walls may be slightly curved or fluted and all formed of self supporting, water resistant, sheet material such as polyethylene plastic 33 preferably about one eighth of an inch in thickness. Each container 26 is of truncated pyramidal configuration, the rear and side walls 27, 28 and 29 inclining just sufficiently to permit the nesting of the containers, one within the other, for storage, or shipment as shown in FIGS. 7 and 8. The front wall 31 inclines inwardly and downwardly to a greater degree than the other walls, as shown, not only for nesting purposes but also to create a wide, trash receiving opening 34 in the plane of the large upper opening 35 of the next lower container. The front wall may be slightly curved to increase the side of the opening. The trash opening 34 is thus not in the front of the bin but is in the top of the bin and extends from the front upper edge 36 of a lower bin to the front lower edge 37 of the bottom of the next higher bin in the stack. It extends between the upper side edges 38 and 39 of the side walls 28 and 29 of a container.

A generally vertical exterior band 41 preferably extends around at least the front and side walls 28, 29 and 31 of each container, the band being one to two inches in height and proximate the upper edges 36, 38 and 39. The front portion of band 41 receives an adhesive label bearing the designation of the trash to be placed therein and the indentations, or shoulders 42 and 43 below the band provide nesting bars as well as convenient, non-slip handles for lifting the bins onto and off the stack.

Each tapered, nestable, five walled container 26 is preferably blow molded in two halves and includes at least two downwardly projecting fastening elements 44 and 45, integrally molded therewith along the axial centre line and each including a neck 46 and an enlarged head 47 of arrow head shape for snap fit purposes explained below.

Each container 26 of each bin 21, 22, 23 or 24 also includes an enlarged base 48, of suitable sheet material such as polystyrene about one eighth inch in thickness or alternatively molded in a laterally extended design. Each base 48 is provided with at least two holes 49 and 51 along the axial centre line of the flat, planar central portion 52 thereof. The arrow headed fastening elements 44 and 45 of the bottom 32 of each container 26 snap fit into the holes 49 and 51 of a base 48 to form an integral, bodily transportable unit therewith. Thus the bases are shippable separately from the nestable tapered containers but are easily snap fitted to the container by the householder. It should be noted that while the upstanding walls of a four sided container could probably be snap fitted to an enlarged separate bottom, to eliminate a separate base, there would be leakage around the bottom and inadvertent fall out of the bottom would be disastrous. By providing an integral, closed bottom to my containers and attaching an enlarged base, the danger of fall out of trash or leakage is avoided and the strength of a doubled bottom is achieved.

Each base thus underlies the lower face 53 of the bottom 32 of a container 26 and is removably affixed thereto. The base also has a downwardly depending peripheral rear flange 54 and opposite side flanges 55 and 56 which closely fit around the upper edges of the rear and side walls of the next lower container.

Each base 48 preferably includes a pair of spaced apart, upstanding integral buttress members 57 and 58 each having a front face 59 and an inclined rear face 61, the rear face 61 removably engaging the inclined front wall of the container snap-fitted on the base to restrain forward tilting of the container of the base when full.

Each base 48 also preferably includes an integral boss 62 projecting downwardly from the underface 63 thereof, the boss 62 having an inclined forward face 64 and a vertical rearward face 65 whereby the base may be slid rearwardly until the upper rear edge 66 of the next lower container is received and locked between the rear flange 54 and the rear face 65 to prevent sliding movement but permit upward movement.

Each base 48 also preferably includes at least one downward projecting, integral leg 67, intermediate of the under face 63 and having a terminal tip 68 in the plane of the lower edge 69 of the rear and side flanges 54, 55 and 56 to lend support to the central portion 52 of the base, when the base is supporting a stack thereabove.

A central opening 71 is cut out, or formed in the central portion 52 of each base for economy of material reasons.

Figure 1:
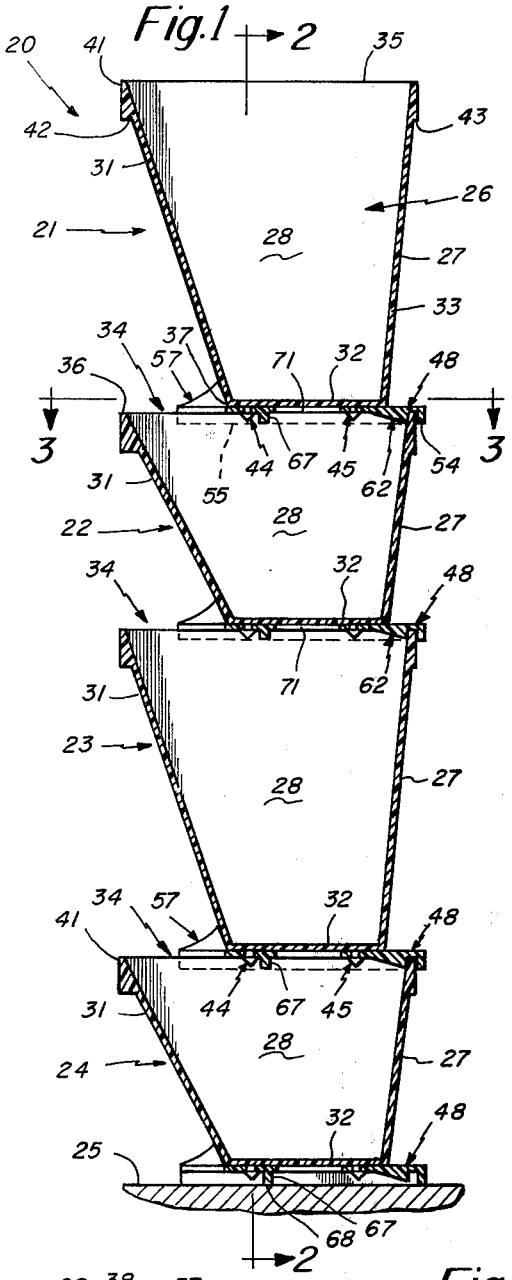
FIG. 1 is a side elevation in half section on line 1—1 of FIG. 2 of a vertical stack of bins constructed in accordance with the invention.
Figure 2:
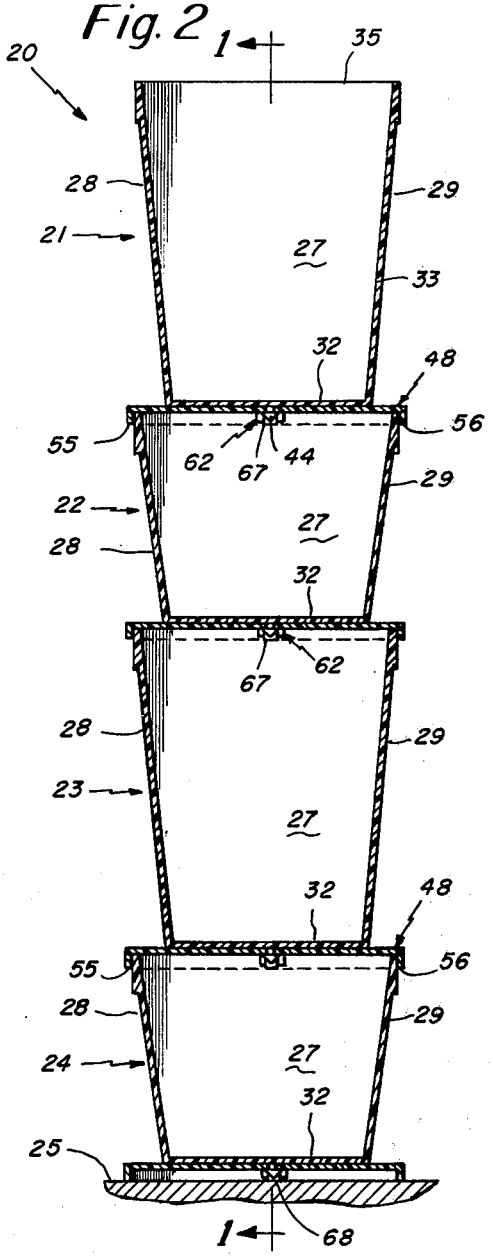
FIG. 2 is a front elevation in half section on line 2—2 of FIG. 1 thereof.
Figure 3:
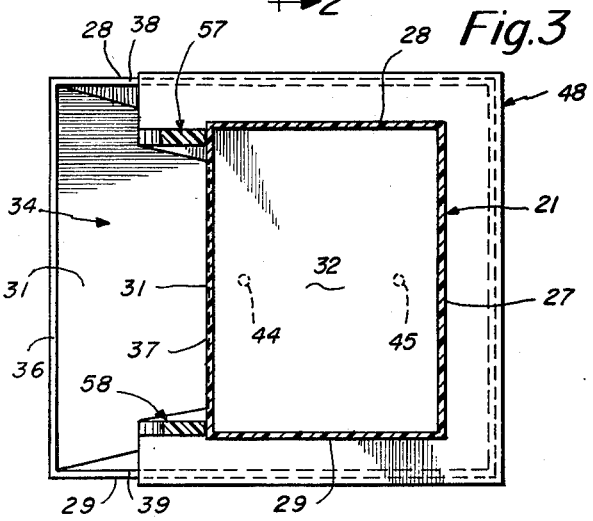
FIG. 3 is a top plan view in section on line 3—3 of FIG. 1.
Figure 4:
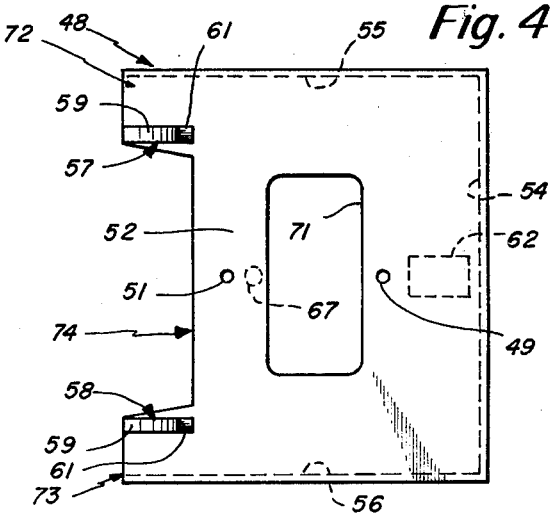
FIG. 4 is a top plan view of one of the enlarged bases of the invention.
Figure 5:
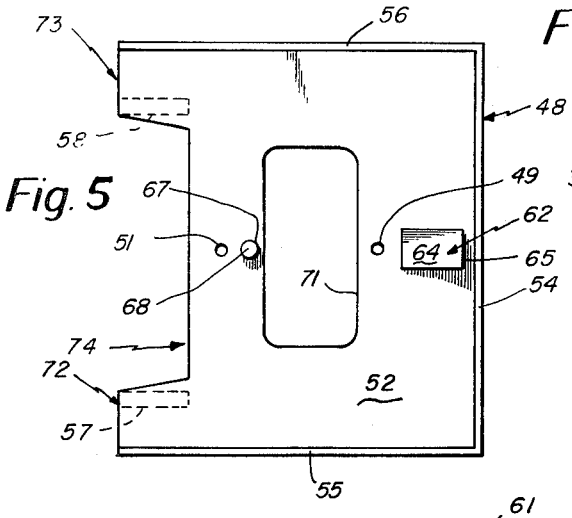
FIG. 5 is a bottom plan view of the base of FIG. 4.

The area of each base 48 is substantially greater than the corresponding area of each container bottom 32 as best shown in FIG. 3, the area of the base being sufficient to form at least a partial cover over the large opening at the top of a container. Each base is also formed with a pair of forward extensions 72 and 73 on each opposite side of a cut out, or recess 74, the recess 74 providing more space for receiving trash while the extensions continue to support the container on the walls of the next lower container.

As shown in FIG. 6A, in place of the arrow headed fastening elements 44 and 45 in the bottom of each container 26 and the holes 49 and 51 in the bases 48 for snap fit therein, each container 26 may have its bottom 32 formed with a dropped section 76, constituting a headed element, having an outer periphery 77 of concave rounded cross section for a firm, force, snap fit in the inner periphery 78, of convex cross section, of the opening 71 in a base 48. Thus the bases 48 may be shipped separately and joined by snap fit to a container, upon delivery. The walls are shown with flutes 79 to give additional strength.

I claim:

1. A vertical stack of removable bins:

each bin comprising a container having an integral bottom wall, a front wall, a rear wall and a pair of opposite side walls, all formed of self supporting, water-resistant, sheet material, and each bin having a separable enlarged base underlying, and removably affixed to the said bottom wall thereof, said base having downwardly depending flanges along the side and rear edges thereof adapted to closely fit the corresponding upper edges of the rear and side walls of the next lowermost said container to seat thereon the front wall of each said container being inclined downwardly and inwardly from proximate the upper edge thereof to proximate the lower edge thereof to thereby define a top front opening into the next lowermost said container, each said base having a front edge, spaced from the front edge of said top front opening, to define the rear edge of said opening, and each said base being joinably separate from its respective container so that a plurality of said containers may be shipped nested and the bases thereof shipped separately.

2. A stack of bins as specified in claim 1 wherein:
each said container is formed with substantially flat planar walls, said front, back and side walls all tapering inwardly from top to bottom to nest one within the other for shipment.

3. A stack of bins as specified in claim 1 wherein:
said containers are each formed of polyethylene about one eighth inch in thickness
each said base is formed of polystyrene about one eighth inch in thickness
and any one of said bins being interchangeable with the others to form the lowermost bin in the stack.

4. A stack of bins aa specified in claim 1 wherein:
each said base includes at least two holes along the axial centre line thereof and each said bottom wall includes at least two integral, projecting headed elements, each adapted to snap fit in one of said holes to detachably affix said base to said bottom wall.

5. A stack of bins as specified in claim 1 wherein:
each said base includes at least one hole, or opening, proximate the centre thereof and
each said bottom wall includes at least one integral, projecting headed element, or dropped section, adapted to snap fit in said hole, or opening, to detachably affix said base to said bottom wall.

6. A stack of bins as specified in claim 1 wherein:
each said base includes a pair of upstanding, integral buttress members, each having an inclined rear face adapted to removably engage the inclined front face of the front wall of a container affixed thereto to prevent forward tilting due to the overhang of said front wall.

7. A stack of bins as specified in claim 1 wherein:
each said base includes an integral, downwardly projecting, boss centrally located proximate the rear of the underface thereof at a spaced distance from the downwardly depending flange along the rear edge thereof, said boss having an inclined forward face and a vertical rearward face for removably seating on the upper rear edge of the next lowermost container to prevent forward and rearward sliding of an upper container on a lower container.

8. A stack of bins as specified in claim 1 plus:
a plurality of spaced, integral, downward projecting legs on the underface of each said base, each leg terminating in a plane common with the plane of the lower edges of the side and rear flanges thereof, to support said base against sag when said base is in position on the lowermost container of said stack of containers.

9. A stack of bins as specified in claim 1 wherein:
each said container bottom wall includes at least one headed element projecting downwardly from the central portion thereof, each said base includes at least one opening for snap fit receipt of said element, and said base includes an integral, downwardly-projecting boss on the lower face thereof cooperable with the rear flange of said base for receiving the upper rear edge of the next lowermost container.

10. A stack of bins as specified in claim 1 wherein:
the area of each said bottom wall of each container is substantially less than the area of each said base thereof, and each said base includes a pair of forward extensions separated by a cut out space for defining said rear edge of the top opening in the next lowermost container.

11. A bin, adapted to be vertically stacked with similar bins, said bin comprising:
a container having a front, back, bottom and opposite side walls, of water resistant material, said walls being tapered into truncated pyramidal configuration for nesting with similar containers and
said bin having an enlarged base of greater area than the bottom of said container but in underlying contact therewith, said base having downward depending peripheral side and rear flanges adapted to seat around the upper edge of a similar receptacle stacked therebelow
snap-fit means for removably affixing each said base to a bottom of one of said containers
and buttress means on each said base for supporting the receptacle snap-fitted thereon against tilting forwardly when filled.

12. A bin as specified in claim 11 wherein:
said snap-fit means comprises at least one headed element projecting downwardly from the bottom of said container and at least one hole in said base for receiving and retaining one of said headed elements.

13. A bin as specified in claim 11 wherein:
said buttress means comprises a pair of upstanding, integral elements in the upper face of said base adapted to contact the tapered front wall of said container to support said container against forward tilting when said container is full.

14. A bin as specified in claim 11 wherein:
the upright walls of each said container are fluted to increase the strength thereof and at least the front and side walls are formed with a generally vertical exterior band, around the upper edges thereof, for receiving labelling indicating the contents, said band having indented shoulders therebelow constituting non-slip lift handles.

15. A set of at least three bins adapted to be mounted one on the other in a vertical stack and to be separably removable from said stack for segregation of waste material stored therein, each said bin comprising:
a container having upstanding walls tapering from a horizontal upper rim defining a large opening to an integral horizontal bottom of smaller area than that of said opening whereby a plurality of identical said containers may be shipped in nested condition one within the other;
a generally horizontal enlarged base for said container, of sufficiently greater area than the area of said container bottom to rest on the horizontal upper rim of the upper opening of the next lowermost container, said enlarged base having a downwardly depending, integral, peripheral flange closely fitting around the rear and sides of said horizontal upper rim and having a front edge spaced a predetermined distance in rear of the corresponding front edge of the said horizontal upper rim to define a top opening with said next lowermost container for receiving waste material of the paper, can, bottle or garbage type and
fastening means for removably affixing the integral bottom of each container to the enlarged base thereof
whereby said tapered containers may be shipped nested without attachment of said enlarged base, but once assembled each enlarged base and its container becomes an integral, bodily transportable unit.

* * * * *